US009254648B2

(12) United States Patent
Harada et al.

(10) Patent No.: US 9,254,648 B2
(45) Date of Patent: Feb. 9, 2016

(54) RECORDING APPARATUS

(71) Applicant: SEIKO EPSON CORPORATION, Tokyo (JP)

(72) Inventors: Kazumasa Harada, Matsumoto (JP); Satoshi Hamano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 189 days.

(21) Appl. No.: 13/959,579

(22) Filed: Aug. 5, 2013

(65) Prior Publication Data

US 2014/0036000 A1 Feb. 6, 2014

(30) Foreign Application Priority Data

Aug. 6, 2012 (JP) ..... 2012-173746

(51) Int. Cl.
*B41J 2/14* (2006.01)
*B41J 2/16* (2006.01)
*B41J 2/175* (2006.01)

(52) U.S. Cl.
CPC *B41J 2/14* (2013.01); *B41J 2/1752* (2013.01); *B41J 2/1753* (2013.01)

(58) Field of Classification Search
CPC ..... B41J 19/202; B41J 19/30; B41J 2/04511; B41J 2/14072; B41J 2002/14491; B41J 2/14; B41J 2/1623; H01M 2/10; H01M 2/1005; H01M 2/1011; H01R 13/65802; H01R 13/6582; H01R 13/6583
USPC ..... 347/37, 50, 58, 86
See application file for complete search history.

(56) References Cited

U.S. PATENT DOCUMENTS

| | | | | |
|---|---|---|---|---|
| 5,235,353 | A * | 8/1993 | Hirano et al. | 346/145 |
| 5,467,116 | A * | 11/1995 | Nakamura et al. | 347/50 |
| 5,506,611 | A * | 4/1996 | Ujita et al. | 347/86 |
| 5,971,525 | A * | 10/1999 | Inoue et al. | 347/50 |
| 6,062,667 | A * | 5/2000 | Matsui et al. | 347/19 |
| 6,312,084 | B1 * | 11/2001 | Ujita et al. | 347/19 |
| 6,959,980 | B2 * | 11/2005 | Heberling et al. | 347/50 |
| 2002/0030715 | A1 * | 3/2002 | Takata | B41J 2/14209 347/37 |
| 2002/0113841 | A1 * | 8/2002 | Nishiberi | 347/50 |
| 2002/0118248 | A1 * | 8/2002 | Inoue et al. | 347/37 |
| 2004/0218005 | A1 * | 11/2004 | Brugue | B41J 19/202 347/37 |
| 2006/0250426 | A1 * | 11/2006 | Wanibe et al. | 347/7 |
| 2006/0250451 | A1 * | 11/2006 | Suzuki et al. | 347/58 |
| 2010/0309266 | A1 * | 12/2010 | Matsumoto | B41J 2/17546 347/86 |
| 2013/0083125 | A1 * | 4/2013 | Tanaka et al. | 347/37 |

FOREIGN PATENT DOCUMENTS

| | | |
|---|---|---|
| JP | 07-266662 | 10/1995 |
| JP | 2007-035800 | 2/2007 |
| JP | 2011-218746 | 11/2011 |

* cited by examiner

*Primary Examiner* — Matthew Luu
*Assistant Examiner* — Patrick King
(74) *Attorney, Agent, or Firm* — Workman Nydegger

(57) ABSTRACT

A recording apparatus includes a recording head, a carriage having an opening on which the recording head is mounted in a state that the liquid ejection surface of the recording head faces the opening, the carriage being configured to reciprocate, a ground member that is mounted on the carriage so as to ground the recording head, and a sensor unit that is mounted on the carriage so as to perform sensing by using reciprocation of the carriage and has a ground mechanism which is connected to the ground member, wherein the ground member is disposed at a position in contact with the recording head mounted on the opening.

8 Claims, 5 Drawing Sheets

RECORDING APPARATUS

BACKGROUND

1. Technical Field

The present invention relates to a recording apparatus, such as an ink jet printer, that includes a recording head mounted on a carriage, and more specifically to a ground structure of the recording head.

2. Related Art

As described in JP-A-7-266662, a recording head in a recording apparatus is generally grounded for purposes of stabilization of operation, decrease of the effect of noise and so on. The ground structure described in JP-A-7-266662 is formed by using signal wires installed around the recording head.

However, the ground structure in the recording apparatus has not been easy to assemble and has had a complicated structure, which has led to increase in cost.

SUMMARY

An advantage of some aspects of the invention is that a recording apparatus which includes a recording head with a compact and easy to assemble ground structure is provided.

According to a first aspect of the invention, a recording apparatus includes a recording head, a carriage having an opening on which the recording head is mounted in a state that the liquid ejection surface of the recording head faces the opening, the carriage being configured to reciprocate, a ground member that is mounted on the carriage so as to ground the recording head, and a sensor unit that is mounted on the carriage so as to perform sensing by using reciprocation of the carriage and has a ground mechanism which is connected to the ground member, wherein the ground member is disposed at a position in contact with the recording head mounted on the opening.

Generally, the recording head is mounted on the carriage with the liquid ejection surface for ejecting ink or the like facing the opening of the carriage. In this embodiment, the ground member is disposed at a position in contact with the recording head mounted on the opening. Accordingly, connection between the recording head and the ground member can be achieved by mounting the recording head on the opening, which enables easy assembly of the ground structure of the recording head. Further, a compact ground structure can be achieved. The term "ground mechanism" refers to a mechanism that includes a wire for ground. For example, the sensor unit has a circuit substrate which is connected to a flexible flat cable (hereinafter, also referred to as "FFC") so as to connect the signal wires, and is also connected to a ground wire, thereby forming the ground mechanism. Since the recording head is grounded by using the ground mechanism of the function unit such as the sensor unit mounted on the carriage, a dedicated ground mechanism is not necessary and the ground structure can be simplified. Further, the ground structure can be easily assembled.

According to a second aspect of the invention, in the recording apparatus in the first aspect, the ground member has a free end that extends to an inside of the opening such that the free end comes into contact with the recording head.

Accordingly, in a simple configuration in which the free end of the ground member such as the leaf spring extends to the inside of the opening, the recording head comes into contact with the free end and the ground structure can be formed by mounting the recording head on the opening.

Therefore, the ground structure can be easily assembled, and a compact ground structure can be achieved.

According to a third aspect of the invention, in the recording apparatus in the second aspect, the sensor unit includes a circuit substrate, and the circuit substrate and the ground member are fixedly mounted on the carriage by using the same fixture member.

Accordingly, the ground member such as the leaf spring is fixedly mounted by using the fixture member for mounting the circuit substrate of the sensor unit. That is, the ground member can be fixedly mounted by using a fixture member for mounting other member without a need of using a dedicated fixture member. Therefore, the number of components and assembly man-hours can be reduced.

According to a fourth aspect of the invention, in the recording apparatus in the third aspect, the opening and the ground member are disposed on a bottom face of the carriage.

Accordingly, since both the recording head mounted on the opening and the ground member are disposed on the bottom face of the carriage, the ground structure of the recording head can be easily assembled. Further, a compact ground structure can be achieved.

According to a fifth aspect of the invention, in the recording apparatus in the fourth aspect, proximal ends of the circuit substrate and the ground member are disposed inside and on the bottom face of the carriage.

Accordingly, since both the proximal ends of the circuit substrate and the ground member are disposed inside and on the bottom face of the carriage, the liquid ejected from the recording head is prevented from attaching on the circuit substrate or the ground member, thereby reducing risk of damaging the function of ground. Further, connection between the circuit substrate and the ground member can be easily achieved.

According to a sixth aspect of the invention, in the recording apparatus in the fifth aspect, the recording head has a conductive member disposed on at a portion of the periphery or the entire periphery of the liquid ejection surface, and the ground member comes into contact with a stepped portion which is a conductive member and is recessed from the liquid ejection surface.

Accordingly, since the ground member comes into contact with the stepped portion which is recessed from the liquid ejection surface of the recording head, the ground member can be prevented from coming into contact with and damaging the liquid ejection surface.

According to a seventh aspect of the invention, in the recording apparatus in the sixth aspect, the ground member is an elastic body that elastically comes into contact with the recording head, and the elastic body is mounted in a state that an elastic force is applied to the recording head.

Accordingly, since the elastic body is mounted in the state that an elastic force is applied to the recording head, even if the recording head is moved in the liquid ejection direction relative to the carriage, the displacement of the recording head is absorbed by elastic deformation of the elastic body, thereby the contact state of the recording head for ground can be automatically maintained.

According to an eighth aspect of the invention, in the recording apparatus in the seventh aspect, the free end of the elastic body has a portion inclined to the bottom face of the carriage and is configured to generate an elastic force when the recording head is mounted.

Accordingly, an elastic force can be generated with a simple configuration.

According to a ninth aspect of the invention, in the recording apparatus in the eighth aspect, the ground member has a plurality of free ends and is configured to be in multiple-point contact with the recording head.

Accordingly, since the ground member can be in multiple-point contact with the recording head, the reliability in contact with the recording head can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
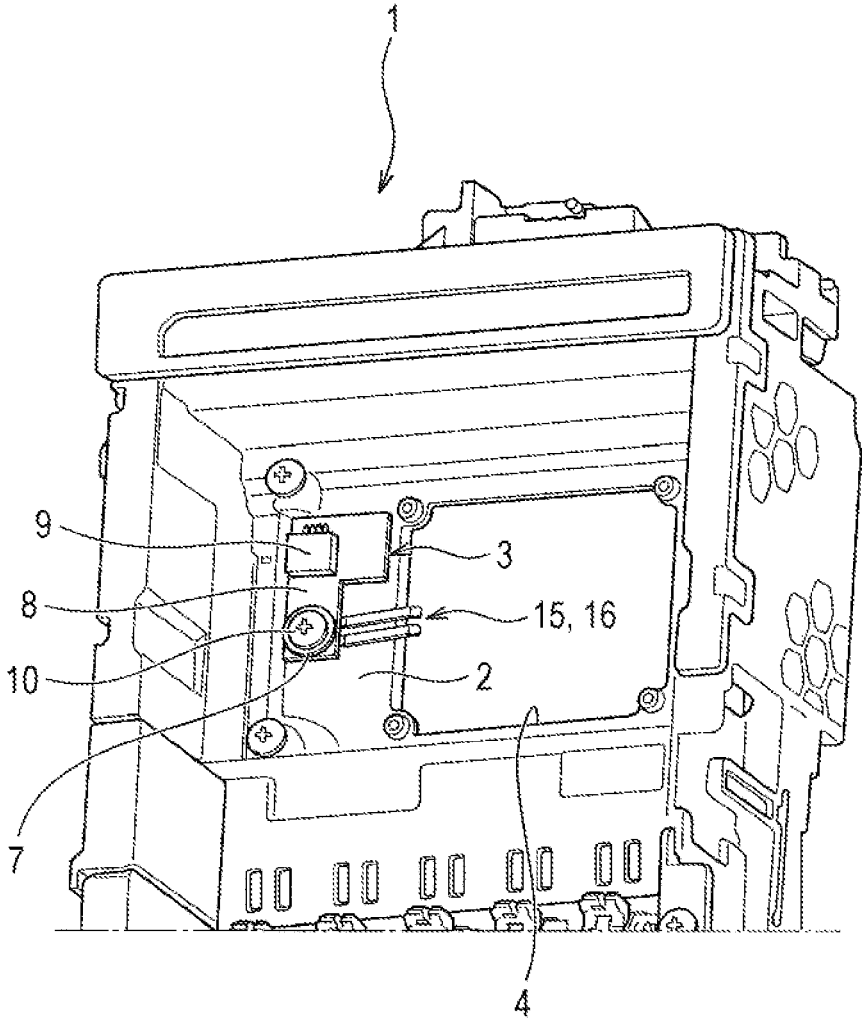
FIG. 1 is an enlarged perspective view of an essential part of a carriage of an ink jet recording apparatus according to an embodiment of the invention before a recording head is mounted.

An embodiment of the invention will be described below in detail with reference to the drawings. As shown in FIG. 1, an optical sensor unit 3 which is a function unit is disposed on a bottom face 2 of a carriage 1 of the ink jet printer. The sensor unit 3 is a device for detecting a width of a recording medium. The sensor unit 3 calculates the width of the recording medium based on variables of the reflectivity of the recording medium when the carriage 1 reciprocates in the width direction of the recording medium.

Figure 6:
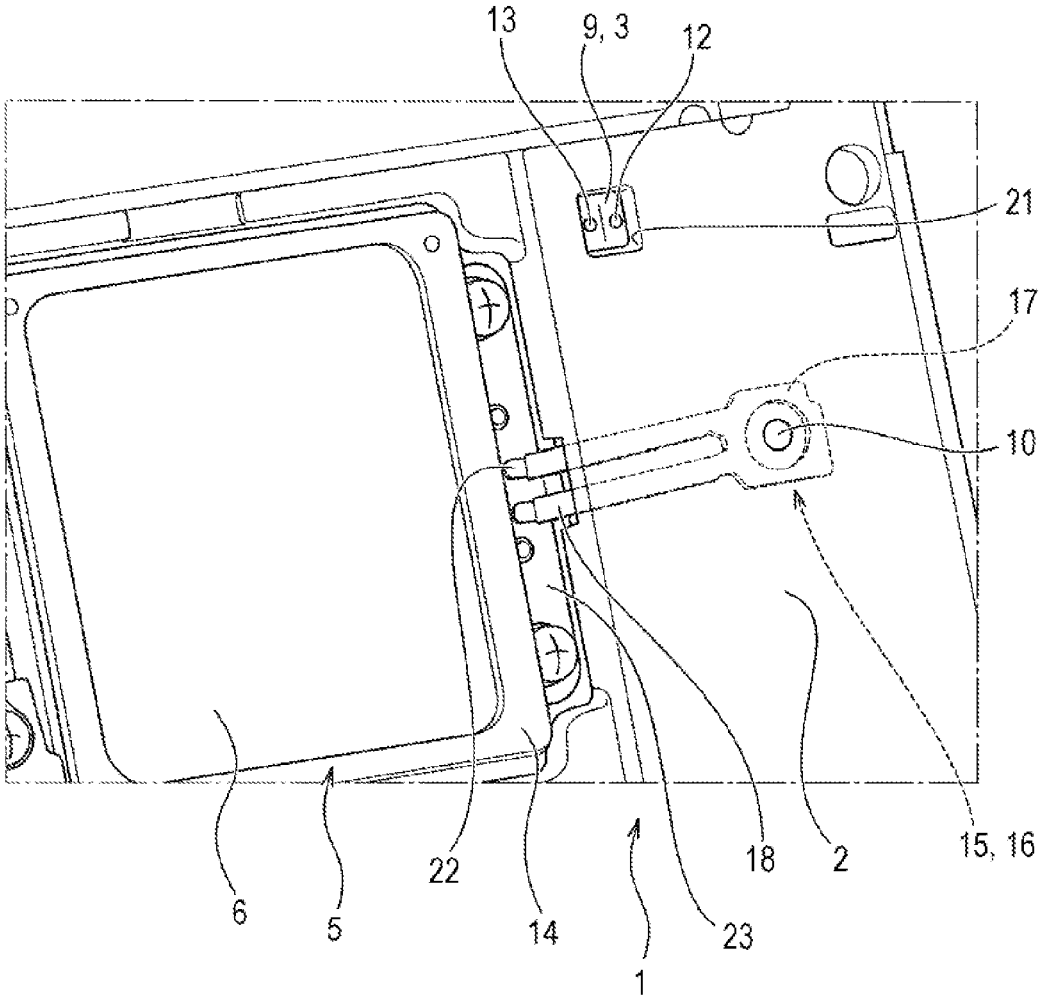
FIG. 6 is an enlarged view of an essential part of FIG. 5.

The sensor unit 3 is a known device and includes a circuit substrate 8 and a light receiving/emitting element 9. In FIG. 6, reference numeral 12 denotes a light emitting element of the light receiving/emitting element 9 and reference numeral 13 denotes a light receiving element of the light receiving/emitting element 9. When the carriage 1 reciprocates in the width direction of the recording medium, the sensor unit 3 performs a calculation by detecting a reflected light of a light emitted from the light emitting element 12 at the light receiving element 13.

Figure 2:
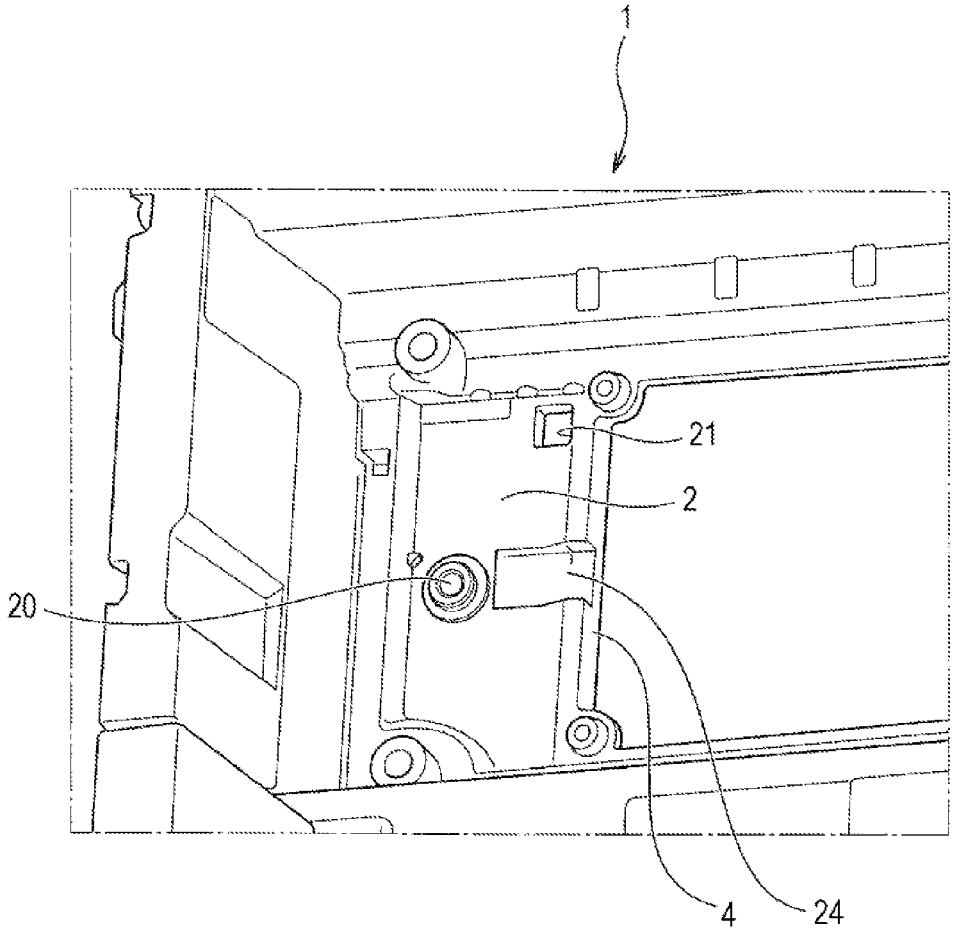
FIG. 2 is an enlarged perspective view of an essential part of the carriage according to the embodiment of the invention showing that a function unit of the carriage is removed.
Figure 4:
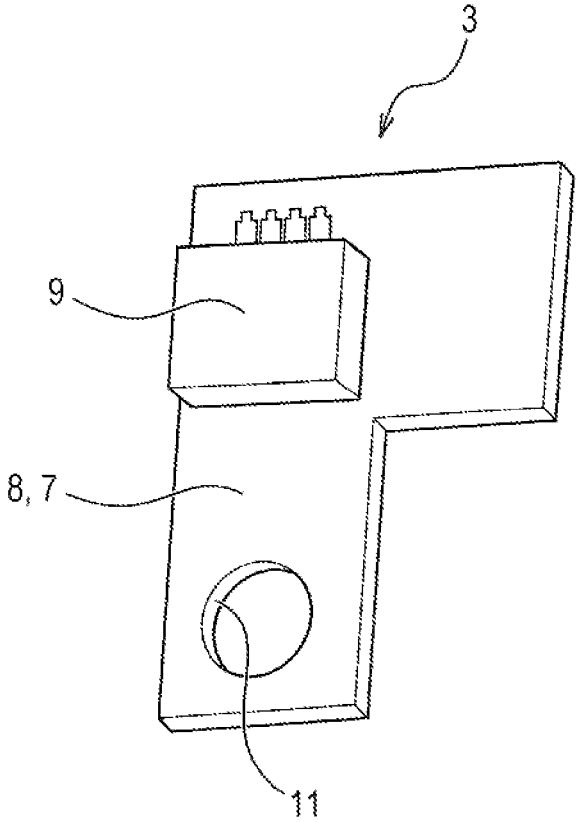
FIG. 4 is a perspective view of the function unit according to the embodiment of the invention.

The circuit substrate 8 is fixedly mounted on the bottom face 2 by using a screw 10. In FIG. 4, reference numeral 11 denotes a hole for inserting the screw 10. In FIG. 2, reference numeral 20 denotes a screw hole through which the screw 10 is threaded, and the screw hole 20 is disposed on the bottom face 2. Further, in FIG. 2, reference numeral 21 denotes a hole which faces the light receiving/emitting element 9.

The sensor unit 3 includes a ground mechanism 7 to stabilize the operation, for example. The ground mechanism 7 is of a known structure and is configured such that, for example, the circuit substrate 8 is connected to an FFC (not shown) and thus a ground wire of the FFC, thereby forming the ground mechanism 7. The function unit of the invention is not limited to the optical sensor unit 3. Other unit mounted on the carriage 1 and has a ground mechanism can also be used.

Figure 5:
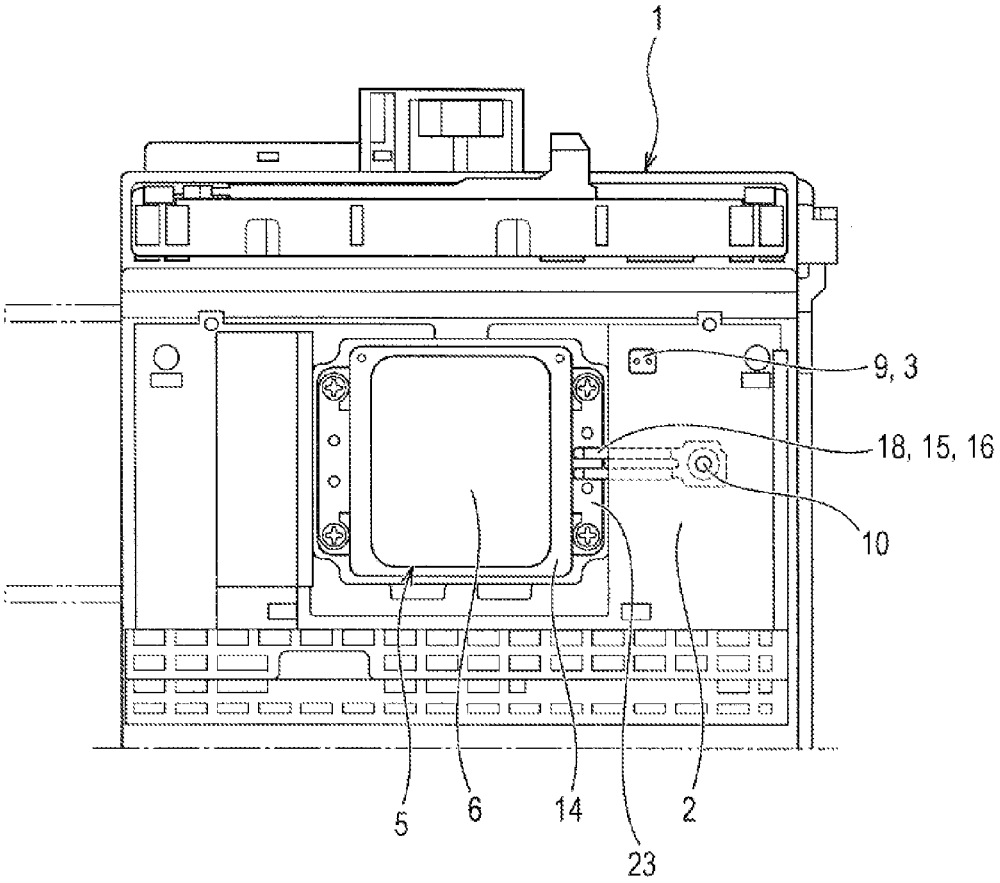
FIG. 5 is a plan view of the carriage on which the recording head is mounted according to the embodiment of the invention as seen from a liquid ejection surface.

In this example, an opening 4 is formed at a substantially center of the bottom face 2 of the carriage 1. As shown in FIG. 5, the recording head 5 is mounted on the carriage 1 in the state that the liquid ejection surface 6 of the recording head 5 faces the opening 4. A metal frame 14 which is a conductive member is provided around the liquid ejection surface 6. The frame 14 has a stepped portion 23 which is recessed from the liquid ejection surface 6.

Although the above described opening 4 is formed at a substantially center of the bottom face 2 of the carriage 1, the configuration of the opening 4 is not limited thereto, and the opening 4 may also be formed at a position offset from the center. Further, the bottom face 2 and the recording head 5 may be configured as a single unit with the entire bottom face of the carriage 1 being open. In this configuration, the recording head 5 mounted on the carriage 1 constitutes the bottom face 2 of the carriage 1. Also, the function unit disposed on the bottom face 2 or on the carriage 1 can be used similarly to that in the above-mentioned configuration.

As shown in FIGS. 1, 5 and 6, the recording head 5 is connected to the sensor mechanism 7 of the sensor unit 3 via the ground member 15. The ground member 15 is disposed at a position in contact with the recording head 5 mounted on the opening 4.

Figure 3:
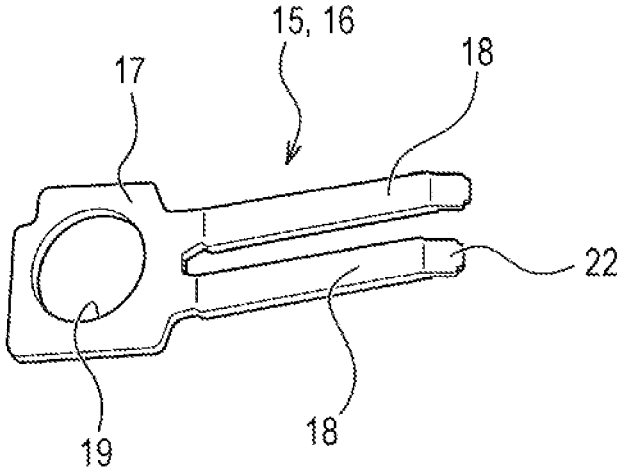
FIG. 3 is a perspective view of a leaf spring of a ground member according to the embodiment of the invention.

In this embodiment, the ground member 15 is formed by an elastic leaf spring 16. As shown in FIG. 3, the leaf spring 16 includes a proximal end 17 and free ends 18. A hole 19 for inserting the screw 10 is disposed on the proximal end 17. In this embodiment, the free ends 18 are formed by two spring pieces and are configured to be in multiple-point contact with the recording head 5. The free ends 18 are not limited to the two pieces, and one free end 18 and three or more free ends 18 are also possible.

The proximal end 17 of the leaf spring 16 is fixedly mounted on the circuit substrate 8 by using the screw 10 so as to be connected to the ground mechanism 7. That is, the leaf spring 16 is fixedly mounted without a need of using a dedicated screw. As shown in FIG. 2, the ground member 15 is set in a mounting recess 24 which is formed on the periphery of the opening 4 on the bottom face 2 of the carriage 1. The recess 24 is not shown in FIG. 1.

Since the proximal ends of the circuit substrate 8 and the ground member 15 are placed inside and on the bottom face of the carriage 1, the liquid ejected from the recording head 5 is prevented from attaching on the circuit substrate 8 or the ground member, thereby reducing risk of damaging the function of ground. Further, connection between the circuit substrate 8 and the ground member 15 can be easily achieved.

The free ends 18 of the leaf spring 16 extend to the inside of the opening 4. With this configuration, when the recording head 5 is mounted on the opening 4, the free ends 18 of the leaf spring 16 come into contact with the stepped portion 23 of the frame 14 of the recording head 5 as shown in FIG. 6 and ground is achieved. The leaf spring 16 applies an elastic force to the stepped portion 23 of the recording head 5. That is, the leaf spring 16 is configured such that the free ends 18 of the leaf spring 16 are elastically pressed against the stepped portion 23, in other words, the leaf spring 16 has a portion inclined to the bottom face of the carriage 1 and is configured to generate an elastic force when the recording head 5 is mounted on the carriage 1. Accordingly, an elastic force can be generated with a simple configuration.

Since the free ends 18 of the leaf spring 16 come into contact with the stepped portion 23 of the recording head 5, the leaf spring 16 is prevented from coming into contact with and damaging the liquid ejection surface 6 of the recording head 5. In addition, the tips 22 of the free ends 18 of the leaf spring 16 are bent in a direction away from the liquid ejection surface 6 of the recording head 5. With this configuration, when the recording head 5 is mounted on the opening 4, the tips 22 of the free ends 18 are prevented from abutting and damaging the liquid ejection surface 6.

In this embodiment, the ground member 15 is disposed in the state of being in contact with the recording head 5 mounted on the opening 4. Accordingly, connection between the recording head 5 and the ground member 15 can be achieved by mounting the recording head 5 on the opening 4, which enables easy assembly of the ground structure of the recording head 5. Further, a compact ground structure can be achieved.

According to this embodiment, in a simple configuration in which the free ends 18 of the ground member 15 such as the leaf spring 16 extend to the inside of the opening 4, the recording head 5 comes into contact with the free ends 18 and the ground structure can be formed by mounting the recording head 5 on the opening 4. Accordingly, the ground structure can be easily assembled, and a compact ground structure can be achieved.

In this embodiment, the spring 16 that forms the ground member 15 is mounted in the state that an elastic force is applied to the recording head 5. Accordingly, even if the recording head 5 is moved in the liquid ejection direction relative to the carriage 1, the displacement of the recording head 5 is absorbed by elastic deformation of the spring 16, thereby the contact state of the recording head 5 for ground is automatically maintained. For example, when the recording head 5 is mounted on the opening 4 of the carriage 1, even if the recording head 5 is moved in the liquid ejection direction relative to the carriage 1 to adjust the relative positions, the displacement of the recording head 5 is absorbed by elastic deformation of the spring 16. That is, the recording head 5 automatically remains contact with the ground member 15. Accordingly, assembly of the ground structure and assembly of the recording head to the carriage can be easily achieved.

Moreover, the recording apparatus may include a gap adjustment mechanism that adjusts a gap between the liquid ejection surface 6 of the recording head 5 and a recording material (not shown) supported by a platen (not shown), which is a so-called paper gap, regardless of the thickness of the recording material. The gap adjustment mechanism can be configured by a mechanism that moves the recording head 5 in the liquid ejection direction relative to the carriage 1. In this embodiment, even if the gap adjustment mechanism of the recording apparatus is activated, the recording head 5 automatically remains in contact with the ground member 15 due to elastic deformation of the spring 16.

Further, in this embodiment, since the ground member 15 comes into contact with the stepped portion 23 which is recessed from the liquid ejection surface 6 of the recording head 5, the ground member 15 can be prevented from coming into contact with and damaging the liquid ejection surface 6.

Other Embodiment

Although the recording apparatus 1 of this invention essentially has the above-mentioned configuration, part of the configuration may be modified or omitted without departing from the spirit of the invention.

For example, the leaf spring 16 of the ground member 15 is not limited to a flat shape as described in the above embodiment, and may be formed in any shape such as a curved shape and S-shape. Alternatively, in the case where a plurality of function units are provided, a plurality of ground members may be provided for the respective function units.

The term "spring" as used herein is not limited to the leaf spring 16, and may include other springs such as a coil spring. Further, the stepped portion 23 of the conductive member may be disposed as appropriate at a portion of the periphery or the entire periphery of the recording head of the liquid ejection surface.

The entire disclosure of Japanese Patent Application No. 2012-173746, filed Aug. 6, 2012 is expressly incorporated by reference herein.

What is claimed is:

1. A recording apparatus comprising:

a recording head;

a carriage having an opening on which the recording head is mounted in a state that the liquid ejection surface of the recording head faces the opening, the carriage being configured to reciprocate;

a ground member that is mounted on the carriage so as to ground the recording head; and a sensor unit that is mounted on the carriage so as to perform sensing by using reciprocation of the carriage and has a ground mechanism which is connected to the ground member, wherein the ground member is disposed at a position in contact with the recording head mounted on the opening, wherein the ground member has a free end that extends to an inside of the opening such that the free end comes into contact with the recording head, wherein the recording head has a conductive member on at least part of the periphery of the liquid ejection surface, and the free end of the ground member comes into contact with a lower side of a stepped portion which is a conductive member and is recessed from the liquid ejection surface.

2. The recording apparatus according to claim 1, wherein the sensor unit includes a circuit substrate, and the circuit substrate and the ground member are fixedly mounted on the carriage by using a same fixture member.

3. The recording apparatus according to claim 2, wherein the opening and the ground member are disposed on a bottom face of the carriage.

4. The recording apparatus according to claim 3, wherein proximal ends of the circuit substrate and the ground member are disposed inside and on a bottom face of the carriage.

5. The recording apparatus according to claim 1, wherein the ground member is an elastic body that elastically comes into contact with the recording head, and the elastic body is mounted in a state that an elastic force is applied to the recording head.

6. The recording apparatus according to claim 5, wherein the free end of the elastic body has a portion inclined to the bottom face of the carriage and is configured to generate an elastic force when the recording head is mounted.

7. The recording apparatus according to claim 6, wherein the elastic body has a tip which is bent from the inclined portion of the free end toward the bottom face of the carriage.

8. The recording apparatus according to claim 7, wherein the ground member has a plurality of free ends and is configured to be in multiple-point contact with the recording head.

* * * * *